US007572027B2

(12) United States Patent
Zampini, II et al.

(10) Patent No.: US 7,572,027 B2
(45) Date of Patent: Aug. 11, 2009

(54) INTERCONNECTION ARRANGEMENT HAVING MORTISE AND TENON CONNECTION FEATURES

(75) Inventors: Thomas L. Zampini, II, Morris, CT (US); Thomas L. Zampini, Morris, CT (US); Mark A. Zampini, Morris, CT (US)

(73) Assignee: Integrated Illumination Systems, Inc., Morris, CT (US)

( * ) Notice: Subject to any disclaimer, the term of this patent is extended or adjusted under 35 U.S.C. 154(b) by 257 days.

(21) Appl. No.: 11/521,376

(22) Filed: Sep. 15, 2006

(65) Prior Publication Data

US 2007/0058377 A1 Mar. 15, 2007

Related U.S. Application Data

(60) Provisional application No. 60/716,972, filed on Sep. 15, 2005.

(51) Int. Cl.
*F21S 4/00* (2006.01)
*F21S 13/02* (2006.01)

(52) U.S. Cl. ..... 362/225; 362/221; 362/218; 362/285; 362/581; 362/457

(58) Field of Classification Search ..... 362/218, 362/219, 221, 222, 223, 225, 252, 217, 11, 362/249, 285, 581, 800, 240, 432, 457
See application file for complete search history.

(56) References Cited

U.S. PATENT DOCUMENTS

| | | | | |
|---|---|---|---|---|
| 5,343,375 | A * | 8/1994 | Gross et al. | 362/248 |
| 5,607,227 | A * | 3/1997 | Yasumoto et al. | 362/249.06 |
| 5,785,418 | A * | 7/1998 | Hochstein | 362/373 |
| 5,918,962 | A * | 7/1999 | Nagano | 362/146 |
| 6,183,104 | B1 * | 2/2001 | Ferrara | 362/145 |
| 6,361,186 | B1 * | 3/2002 | Slayden | 362/241 |
| 6,561,690 | B2 * | 5/2003 | Balestriero et al. | 362/555 |
| 6,796,680 | B1 * | 9/2004 | Showers et al. | 362/246 |
| 6,880,952 | B2 * | 4/2005 | Kiraly et al. | 362/218 |
| 7,159,997 | B2 * | 1/2007 | Reo et al. | 362/240 |
| 7,213,941 | B2 * | 5/2007 | Sloan et al. | 362/246 |
| 2003/0210546 | A1 * | 11/2003 | Chin | 362/249 |
| 2003/0223235 | A1 * | 12/2003 | Mohacsi et al. | 362/240 |

* cited by examiner

*Primary Examiner*—Jacob Y Choi
(74) *Attorney, Agent, or Firm*—Choate Hall & Stewart; Christopher J. McKenna

(57) ABSTRACT

An interconnection arrangement features a housing having multiple exterior surfaces. The housing is configured to receive an electrical device therein and has a plurality of the multiple exterior surfaces each having at least one mortise connection feature formed therein which is configured to receive a tenon associated with an accessory and to connect the accessory to the housing.

42 Claims, 8 Drawing Sheets

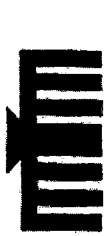
FIG. 7
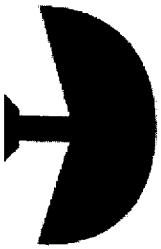
FIG. 8
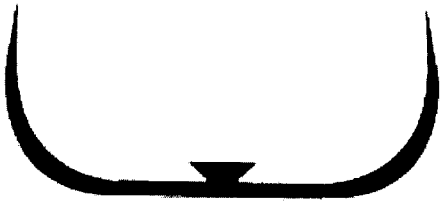
FIG. 9
FIG. 10
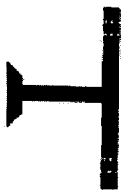
FIG. 11
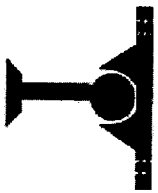
FIG. 12
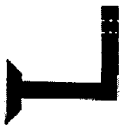
FIG. 13
FIG. 14
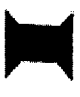
FIG. 15
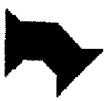
FIG. 16
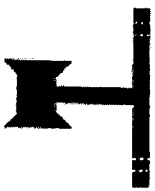
FIG. 17
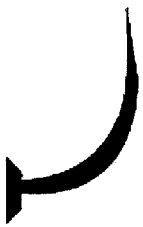
FIG. 18

INTERCONNECTION ARRANGEMENT HAVING MORTISE AND TENON CONNECTION FEATURES

RELATED APPLICATION

The present invention claims priority from Provisional Application No. 60/716,972, filed Sep. 15, 2005, entitled LINEAR LIGHTING UNIVERSAL MOUNTING SYSTEM BASED ON DOVETAIL PRINCIPLES, the disclosure of which is hereby incorporated by reference in its entirety.

BACKGROUND OF THE INVENTION

1. Field of the Invention

The present invention relates generally to a connection arrangement for lighting fixtures and the like, and more specifically to a connection arrangement which is designed to simplify the mounting of fixtures/housings, provide flexibility to the installer of the fixtures/housings, and allow the installer to readily interconnect/interchange selected accessories as required.

2. Description of the Related Art

Traditionally, linear lighting systems, for example, are used for a variety of applications. Most of these systems use fluorescent light tubes and are available in a variety of sizes, intensities, housings, etc. Further, most of these linear lighting systems use some form of mounting accessories that interconnect the fixture housing to a mounting surface. These mounting accessories may include one or a plurality of brackets depending on the size and configuration of the housing.

However, these arrangements tend to suffer from the drawback that they are limited in their adaptability. In fact, many of the mounting features are such that they are intended for a single purpose and essentially no flexibility in the manner in which the light fixture, for example, can be disposed and/or arranged is possible.

SUMMARY OF THE PRESENT INVENTION

The embodiments of the interconnection arrangement according to the present invention incorporate one or more mortises configured to mate with a tenon for mounting accessories to the basic fixture or fixtures. In the disclosed embodiments of the invention dovetail mortises and tenons are used. However, the invention is not specifically limited to the use of dovetail configured connection features and other suitable shapes/configurations are not excluded from the scope of the present invention.

A dovetail, as it will be referred to hereinafter, is taken for the sake of disclosure, to be fan-shaped tenon that forms an interlocking joint when fitted into a corresponding dovetail shaped mortise. The mortise (e.g., dovetail mortise or a mortise having a configuration that will suitably receive a dovetail configured tenon) may be located on one or multiple surfaces of the housing of the fixture. More than one mortise may be provided on the same surface.

In embodiments wherein the mortises extend the full length of the housing/fixture, the housing may be manufactured using low cost methods including extrusion.

The present invention may be constructed of any suitable material including aluminum and plastic. The mortises may be any size. However, in the interest of accessory interchangeability configuring all of the mortises to have the same dimensions can be advantageous.

The mortises may be formed to extend along only select locations of the fixture or run the full length. The mortise and tenon dovetail scheme offers advantages and improvements over existing mounting and accessory systems. The mortise/dovetail configuration is common to every mounting scheme and accessory for the present invention.

One advantage of the mortise/tenon configuration is mounting. Through the use of this configuration, an installer may select from a variety of accessories including mounting brackets, hangers, pivots, and other means of versatile mounting, to develop an arrangement which meets the instant of requirements.

One mounting option is to install one or multiple dovetail equipped mounting devices to a mounting surface (viz., the surface which the fixture will be installed to), and then slide the body/housing in which the mortises are formed, into place in a manner wherein a mortise mates with a dovetail or dovetails. The interconnection between the dovetail mounting device (which has at least one dovetail) and the mortise will allow the installer to easily install and position the housing.

This strategic positioning is promoted by the fact that, as the mortise may run the linear length of the present invention's housing, the dovetail mounting device (or devices) may be located at any position along the linear length. Traditionally, mounting brackets are installed at fixed points on a fixture such that in complicated or difficult installations, traditional brackets do not work well. This is mainly due to the fact that the conventional type brackets are in fixed locations on the housing.

Traditional brackets also typically do not offer the ability to be removed from the fixture, mounted, and then easily reinstalled. As some fixtures/housings are large and heavy, installing this type of fixture with fixed fasteners can prove challenging as the fixture must be held in position and simultaneously secured in position. Therefore, the embodiments of the present invention can eliminate this problem. All that is necessary is to install the dovetail mounting device to the mounting surface and then slide the fixture housing into place.

Some light fixture installations require that the fixture is mounted and then aimed at a "target" that the fixture is to illuminate. For example, some light fixtures that are used for wall grazing (shooting light up or down a wall), will be mounted to the wall and then aimed at a predetermined angle with respect thereto. The present invention simplifies this process as the dovetail mounting device (or devices) may be mounted, adjusted (aimed), secured, and then the housing/fixture installed to the dovetail mounting device by sliding it into place.

With the ability to mount the dovetail mounting device prior to installing the fixture, the dovetail mounting device can be smaller, more plentiful if required, and more discrete when compared to conventional mounting brackets. Traditionally, the mounting screws/bolts etc. and adjustment mechanism (for adjustable versions) of conventional mounting brackets would be required to be mounted such that they are accessible when the fixture is installed. The embodiments of the present invention doe not require this as the dovetail mounting device is mounted first and in then concealed between the fixture and mounting surface.

In some cases, not every surface for mounting a light fixture is suitable, such as in the case when the light fixture/housing which is being mounted is sufficiently heavy that it should not be fully supported by sheet rock or weak paneling/materials, but rather should be mounted to a stud or framing behind the wall facade or covering.

When conventional fixtures are supplied with fixed mounting brackets, the level of difficulty of installation increases as there is sometimes no choice where the mounting brackets can be located. With given embodiments of the present invention, as the mortises run the length of the housing, one may fasten the dovetail mounting device or devices strategically to a frame or stud behind the wall covering, as the dovetail mounting devices do not need to be evenly spaced or located at a fixed location with respect to the fixture/housing. The fixture/housing will slide onto the multiple dovetail mounting devices which are appropriately aligned with one another.

The proposed system is such that the dovetail mounting devices may be installed on the fixture/housing prior to mounting the dovetail mounting devices. An example of such a situation is wherein there is insufficient space to install the present invention by sliding the fixture/housing onto the dovetail mounting devices or when it is simply more convenient for the installer to take this approach.

Nevertheless, the advantages remain the same. As the dovetail mounting devices may slide freely along the dovetail, the mounting brackets may be located where required.

In a situation where multiple fixtures/housings are required, the dovetail/mortise configuration presents a unique opportunity to link or connect two or more fixtures/housings together. This is ideal when, for example, if there is only physical space to mount one fixture on a wall, however the provision of two fixtures is required in order to obtain the desired amount of light output for example.

The installer may, in the above situation, mount a single fixture to the wall and then use a multiple dovetail mounting device to mount two fixtures side by side, or one above the other etc., (such that one fixture is aimed up and the other down). This is achieved by creating a dovetail mounting device that incorporates two or more dovetails such that two or more fixtures/housings may be installed to it.

This multiple dovetail mounting device may be configured at any size, angle, or configuration. It may be configured with or without means to install it directly onto a mounting surface. Some examples include those where a dovetail mounting device will connect one fixture to a mounting surface and a second multiple dovetail mounting device will connect a second fixture to the first. Another example is where a multiple dovetail mounting device is configured in a "T" shape where the multiple dovetail mounting device will mount to a surface and have connected to it multiple fixtures.

One limitation to the number of fixtures installed to a multiple dovetail mounting device is physical space and the number of dovetails on the multiple dovetail mounting device. Through this configuration, a variety of fixture configurations may be achieved including stacked and/or grid array configurations. Through the use of a grid array, fixtures may be connected together to create a variety of intensities and light patterns.

When a rigid dovetail mounting device solution is not available or required, the same concept as described above applies. However, as opposed to having a rigid dovetail mounting device that mates with the mortise and the mounting surface, one may have a wire, cable, or other flexible dovetail mounting device that allows the hanging of the fixture/housing.

In any case, a dovetail may be locked into the mortise with an optional set screw, pin, or similar device to obviate undesired disconnection.

The number of potential dovetail mounting device variations is large and includes, but is not limited to: straight dovetail mounting devices, adjustable dovetail mounting devices, right angle dovetail mounting devices, pivoting dovetail mounting devices, angled dovetail mounting devices, hanging dovetail mounting devices etc. Dovetail mounting devices may have a variety of mounting methods to the mounting surface, some being specific to mounting to materials, others specific to environment.

A common feature of the embodiments of the present invention is that the mounting device will always have one of a mortise and a tenon and that the fixture will always have the other of the mating mortise and tenon.

In the embodiments of the invention, the light source which is used can comprise a plurality of LED (Light emitting diodes). These LED can, in at least one embodiment, be incorporated into a linear housing. By way of example, the linear housing is, in at least one embodiment, configured such that it is populated with high brightness LEDs configured as a light source for general illumination. The HB LEDs are installed to a multilayer or single layer MCPCB which is a printed circuit board with an aluminum or copper substrate via direct solder connection or thermally conductive epoxy. The MCPCB may be configured with one or more high Brightness (HB) LEDs and with or without additional electronic components including current limiting devices (i.e. resistors) and highly efficient drive circuitry such as switching regulators which require a large number of components including an inductor, capacitors, and associated switching circuitry.

In other configurations/embodiments such as shown in the attached drawings, the drive circuitry can at least one instance be installed to a lower optional circuit board (PCB) and is electrically connected to the upper MCPCB with LEDs by means of a flex circuit or other means including discrete wire. In either case, dimming circuitry may be installed to either drive circuit.

The LED MCPCB in one embodiment can attached to the linear housing via screws that pass through the extrusion housing and into a threaded standoff within the inner extrusion, thus clamping the upper unit together for a watertight seal. Alternatively, the upper and lower housings may be screwed together via flat head screws in such a way that the flat head screw holes in the upper extrusion provide a counter sink for the screw heads such that they sit flush with the upper extrusion where the MCPCB installs and such that the threaded shaft of the screw installs to the standoff in the lower housing and as earlier described. The MCPCB is then installed via screws to the upper extrusion only. It should be noted that in both instances, the upper and lower extrusion are clamped together. It should also be noted that in order to provide adequate thermal transfer from the MCPCBs to the upper housing a thermal grease, pad, or other thermally conductive transfer material can be used between the MCPCB and the upper housing.

In order to seal (waterproof) and provide a means of collimating light, a collimating extruded linear optic, typically manufactured from extruded acrylic can be used above the LEDs along the entire length of the upper extrusion. The optic profile affects the uniformity and main beam angle of the light. For example, current designs have been shown to create full beam angles of 15, 30, 45, and 65 degree emitting angles.

Several features can be included with the upper extrusion to accommodate the optic (all which can be configured with a common dimension in regard to width and fit into the upper housing. The first is that there is a shelf that the optic sits on that positions the optic relative to the LEDs with is an important dimension. The second is that there is a rounded cutout above and to the outside of the shelf as defined above. This cutout is designed to roll in a silicone round gasket that compresses between the slope on the edge of the optic and the round cutout, thus retaining the optic and sealing the extrusion from dust and water intrusion.

Regarding electrical connections, at least one embodiment has a connection on each end of the assembly. One connection is a plug, the other is a receptacle. This enables multiple assemblies to be plugged together. Each connector is configured with 4 contact positions, 2 for power, and 2 for dimming signal. Internal to the housing, pass through wires connect the front and back conductors such that voltage is available at the back receptacle.

Electrically connected to the pass through power bus is a wire assembly with connector. This connector connects to the first driver board internal to the housing. Each driver board thereafter plugs together thus carrying the voltage and dimming signal on to teach of the Driver boards. In addition, the first driver board connects to a flex circuit that powers the LED boards. Each driver thereafter that plugs into the next (from which it receives voltage and dimming signals) also provide a regulated output back to the first driver board in which the output is put through the flex circuit and into the LED boards, thus the only 1 flex circuit is required to be used for many feed to the assemblies plugged together.

When the driver circuitry is installed to the LED PCB, thus only 1 PCB is used and not an upper and lower as described herein, then a flex circuit is required rather the LED board will connect direct to the pass through wires.

In other configurations, a junction PCB may be used in place of the driver PCB in this case, the junction PCB will connect to the pass through wires and will connect to the LED board (or multiple)via a flex circuit (one or more). In the case of the Junction PCB, the driver circuits may be located remotes.

The entire assembly is sealed on the ends via plastic injection molded end caps that are also gasketed and have a cutout for the connectors to pass through.

In accordance with a further aspect of the invention the housing can be provided with electrical connectors at each end. These connectors can be configured to allow the housing to be connected with other housings of similar configuration, and thus allow the connection with the other housings forms a daisy chain type of connection.

Yet another aspect of the invention is such that, in connection with the above-mentioned wall glazing, for example, a lens can be disposed with the housing to close a cavity in which the light generating arrangement is disposed and which is configure to direct light produced by the light generating arrangement out of the housing in a predetermined manner.

Accessories

As the fixture/housing may be configured with one or more mortises, in some cases one or more mortise may be used for mounting while one or more of the remaining mortises may be used for installing additional features to the fixture.

One feature that may be added to the fixture/housing using a mortise/tenon configuration is additional heatsinking. Depending on the power of the selected light source, a standard size fixture housing for various reasons may require a heatsink to soak up/disperse excess thermal energy.

The mortise/tenon configuration lends itself well to this scenario by allowing the connection of a heatsink element (e.g. a finned aluminum body formed by extrusion or the like) via a dovetail that is slid into the mortise and used to absorb and release excess heat from the fixture when the fixture is operating. If deemed necessary, thermal grease can be applied to the dovetail to reduce the thermal resistance of the junction between the dovetail of the heatsink element and the fixture.

The dovetail equipped heatsink element offers an advantage to inventory management such that fixture manufacturers may stock a single fixture housing and add dovetailed heatsinks as required depending on the required operating ambient temperature of the fixture (i.e. more heat sinking for higher ambients) and wattage of the light source.

It is should be noted at this point that the fixture/housing should not be taken as being specifically limited to light sources per se and that heating elements, for example, may be disposed in the housing and arranged to direct a beam or beams of infrared radiation (for example) into a room. Indeed, any type of electrical device such as surveillance equipment can be disposed in the housing. Nevertheless, with all type of electrical devices, with highly efficient reflection and/or insulation, still some heat will find its way into the housing and one or more heatsinks can be connected in the above-mentioned manner to prevent the temperature of the housing and/or the mounting elements which are used to support the housing, from rising beyond acceptable limits.

While the embodiments of the invention are in no way limited to the use of LED, in the case wherein the light source comprises one or more LED (light emitting diodes) a number of advantages can be derived. LEDs are capable of emitting light of an intended color without the use of color filters that traditional lighting methods require and there is no heat or ultra violet (UV) radiation in the emitted light. The shape of the LED package allows light to be focused. Incandescent and fluorescent sources often require an external reflector to collect light and direct it in a useable manner. LEDs are robust, insensitive to vibration and shocks. There are no fragile filaments and nothing to break, shatter, or leak unlike incandescent and discharge sources. LEDs are solid state making them hard to break and extremely durable. LEDs have an extremely long life span: typically ten years, twice as long as the best fluorescent bulbs and twenty times longer than the best incandescent bulbs. Further, LEDs fail by dimming over time, rather than the abrupt burn-out of incandescent bulbs. LEDs give off less heat than incandescent light bulbs with similar light output. LEDs light up very quickly with no warm-up times, and no cold-start considerations down to −40° C.

The cost of LED's is higher than the other forms of illumination mentioned above, however, as the usage of these elements is increasing, and as the efficiency of LEDs continue to increase, they will soon surpass the efficiency of a fluorescent source and the cost will continue to decrease.

A further consideration is that LED performance largely depends on the ambient temperature of the operating environment. "Driving" an LED "hard" in high ambient temperatures without adequate heatsinking may result in overheating of the LED package and eventually to device failure. Adequate heat-sinking is therefore required to maintain long life. Embodiments of the invention which utilize a) a heat sink body and b) offer the option of wherein one or more heat sinks can be readily added therefore presents a synergistic combination with LED type illumination.

Another feature that may be added to the fixture/housing using the mortise/tenon configuration is aesthetic covers/decorations. These covers when provided with dovetails can be constructed in a wide variety of materials, and configurations. The dovetail equipped covers allows the fixture manufacturer to stock a single fixture housing that has no particular aesthetic value per se, slide a selected dovetail cover into one or more mortises on the fixture, and create a new pleasing exterior appearance for the fixture.

For example, the fixture/housing could be used for a museum, where a gold plated, engraved dovetail cover is required, or could it be used for a modem corporate park, where a silver space age dovetail cover is preferred. The fixture/housing remains the same, only the dovetail equipped covers require interchange.

Another feature that may be added to fixture/housing using the mortise/dovetail configuration is a feature that will modify the optical properties of the system. While many linear fixtures utilize internal reflectors and optics (depending on the light source), additional reflectors may be used to direct the light beam and/or enhance the efficiency/overall lighting effect. A dovetail equipped reflector may be installed via a mortise on the fixture/housing. One or more dovetail equipped reflectors may be used on a single fixture/housing (see FIGS. 9 and 18 for example). Using such a dovetail reflector(s), light may be shaped in various patterns or distributions.

Light may also be blocked either partially or totally depending on the fixture requirements. For example, one may install a dovetail reflector that mates with the mortise near the light emitting surface of the fixture such that the reflector extends to a position wherein light from the fixture's light generating device is blocked, reflected or redirected in a suitable manner. Other options include manufacturing a single dovetail reflector that mates with a mortise located on the bottom of the fixture, such that the fixture sits on top of the dovetail reflector (see FIG. 9 for example).

It should be noted that all dovetail mounting devices, reflectors, heatsinks etc. will generally enhance the heatsinking properties of the fixture/housing. It should also be noted that one or more of the defined or similar dovetail components may be used with a single present invention.

In addition, it should also be noted that the fixture/housing may have more than one dovetail feature available. Therefore, a single fixture/housing may have a dovetail mounting device, dovetail heatsink, and dovetail reflector installed via one or multiple mortises.

In more specific terms, a first aspect of the invention takes the form of an interconnection system, which has a housing that has multiple exterior surfaces and that is configured to receive an electrical device therein. A plurality of the multiple exterior surfaces of the housing each have at least one mortise connection feature formed therein. These mortises are each configured to receive a tenon associated with an accessory and thus connect the accessory to the housing.

A second aspect of the invention resides in an interconnection arrangement having a housing which has multiple exterior surfaces and which is configured to enclose an electrical device. A plurality of shaped mortise connection features are formed in selected exterior surfaces of the housing. The connection features are configured to receive a shaped tenon associated with an accessory. The system further includes a plurality of accessories each having a shaped tenon receivable in a selected one of the plurality of connection features in an accessory connecting manner.

A third aspect of the invention resides in an interconnection arrangement having an elongate housing having two side walls and a bottom wall; and at least one dovetail mortise formed in each of the two side walls and in the bottom wall, each dovetail mortise having essentially the same dimensions and each configured to connectively engage with a dovetail tenon associated with an accessory.

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

FIG. 7 is a side view depicting the profile of a heatsink which can be connected to the housing using the dovetail that is provided on its base;

FIG. 8 is a side view depicting the profile of a cover which can be connected to the housing using the dovetail that is provided on its base;

FIG. 9 is a side view depicting the profile of a reflector which can be connected to the housing using the dovetail that is provided on its inboard surface;

FIG. 10 is a side view depicting the profile of an angled mounting bracket which can be used to support a housing;

FIG. 11 is a side view depicting the profile of a straight mounting bracket which, like that depicted in FIG. 10, can be fastened to a wall or the like and which can be used to support a housing connected to the housing using the dovetail that is provided on a support extension;

FIG. 12 is a side view depicting the profile of a swivel mounting bracket which can be connected to the housing using the dovetail that is provided on the end of a pivotally mounted member;

FIG. 13 is a side view illustrating the profile of another example of a right angle mounting bracket which can be connected to the housing using the dovetail that is provided at one end;

FIG. 14 is a side view illustrating the profile of a fixture-to-fixture/fixture connection element which can be connected to one or more housings/accessories using the dovetails that are provided at each end;

FIG. 15 is a side view illustrating the profile of another embodiment of a fixture-to-fixture/fixture connection element which can be connected to one or more housings/accessories using the dovetails that are provided at each end;

FIG. 16 is a side view illustrating the profile of a further embodiment of an angled fixture-to-fixture/fixture connection element which can be connected to one or more housings/accessories using the dovetails that are provided at each end;

FIG. 17 is a side view illustrating the profile of a fixture-to-fixture mounting bracket having dual dovetail connection elements;

FIG. 18 is a side view illustrating the profile of another reflector which can which can be connected to the housing using a dovetail that is provided on its base;

DETAILED DESCRIPTION OF THE EXEMPLARY EMBODIMENTS

An embodiment which is directed to a light fixture will now be described with reference to FIGS. 1-21.

FIGS. 1-6 depict a light fixture 100 which, in this particular instance, comprises an elongate housing 102, a lens 104, a plurality of light sources in the form of LED 106, current control circuitry 108, and electrical socket/connector(s) 110 for receiving a mating electrical connection member (not illustrated). In this embodiment, the housing 102 comprises upper and lower extrusion members 102U and 102L which are clamped together and sealed via the use of gaskets 102G.

Figure 4:
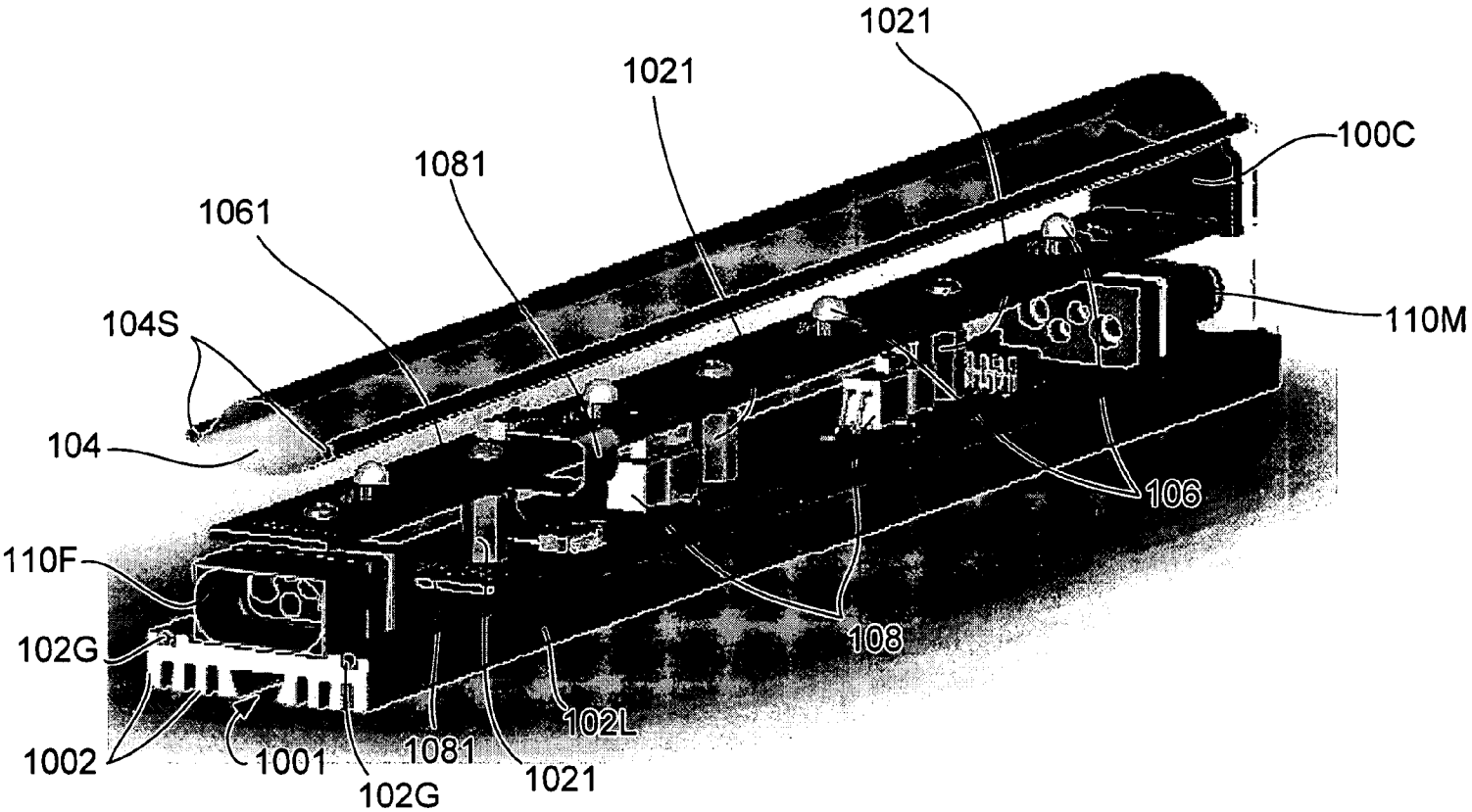
FIG. 4 is a perspective view similar to that depicted in FIG. 3 illustrating further details of the elements which comprise the lighting fixture depicted in FIG. 3 and the manner in which they are mounted relative to one another within the housing.

As best appreciated from FIG. 4 the fixture 100 can be, in one embodiment of the invention, provided at both ends with an electrical socket/connectors 110 and thus allow for a plurality of fixtures 100 to be daisy chained end-on-end in accordance with the length of the final fixture arrangement that is required. These connectors can comprise a female socket member 110F and a male plug member 110M. Alternatively, the interconnection can be achieved by providing connection elements (not shown) that can be inserted into the socket/connectors 110 of housings which are placed end to end in a manner which provides, in at least one embodiment of the invention, both an electrical connection as well as a physical, supportive connection. The endmost socket/connectors can respectively connect with a source of electrical power and closed by a dummy plug. The electrical power source connection can be achieved such as through the use of a cord having the appropriate connection element provide one end thereof.

Figure 1:
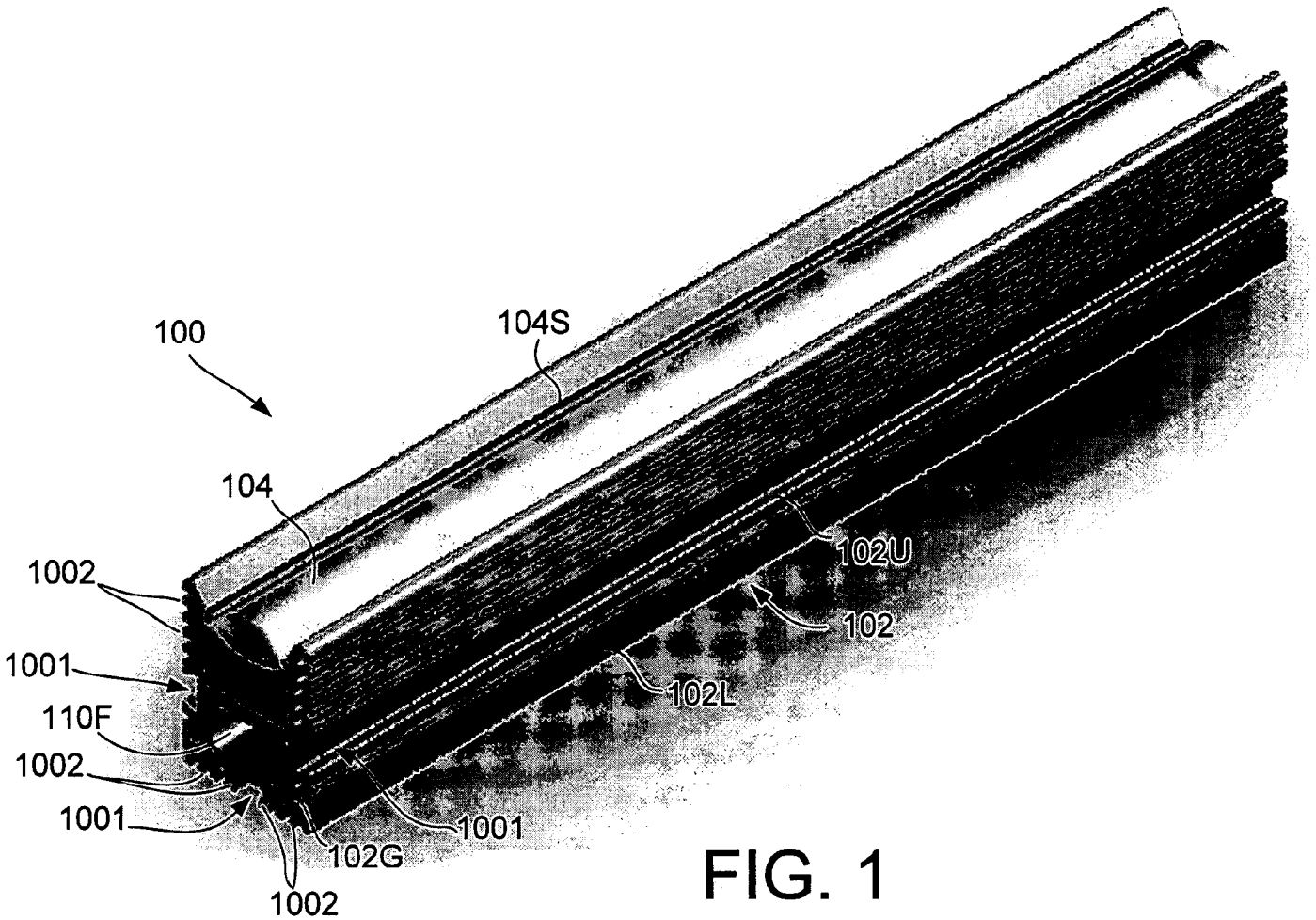
FIG. 1 is a perspective view of an exemplary embodiment of the invention.
Figure 2:
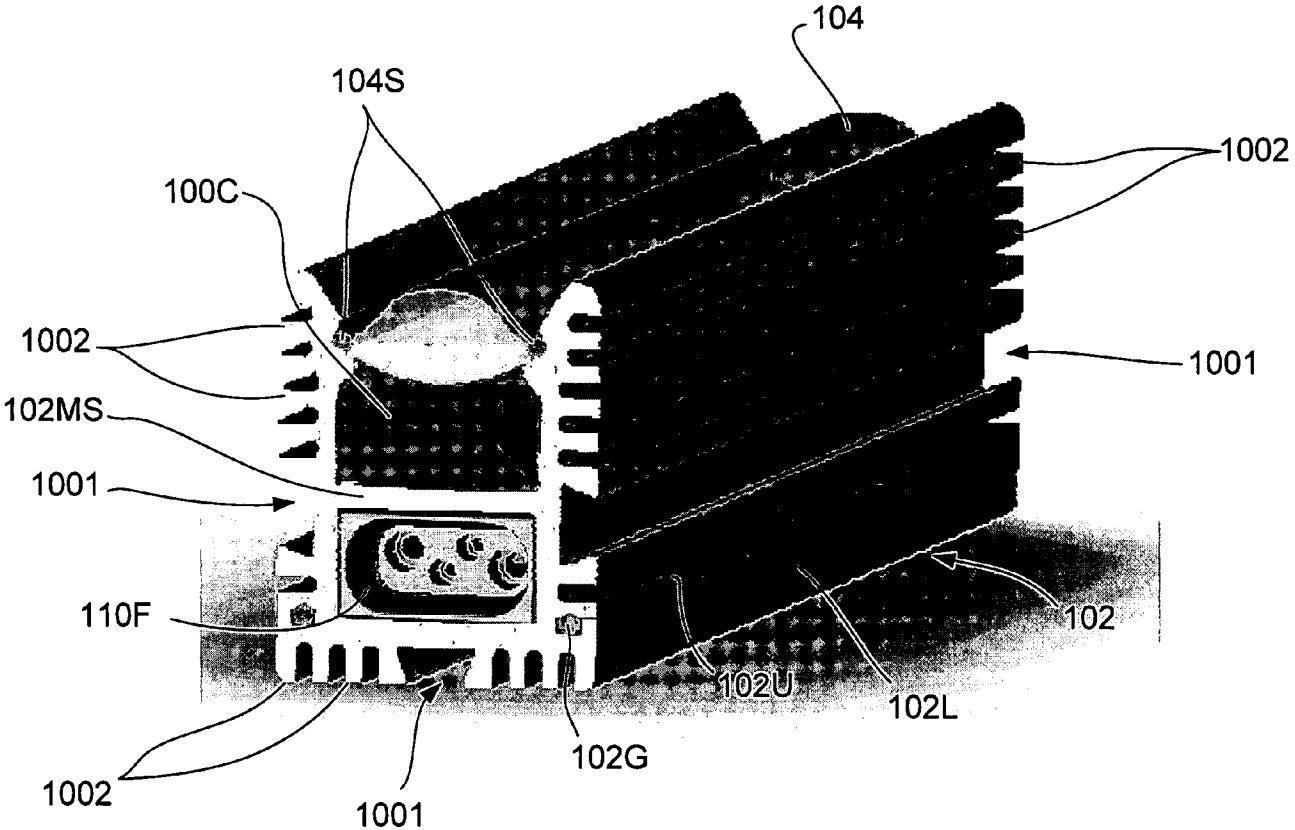
FIG. 2 is perspective sectional view of a portion of the lighting fixture depicted in FIG. 1.
Figure 3:
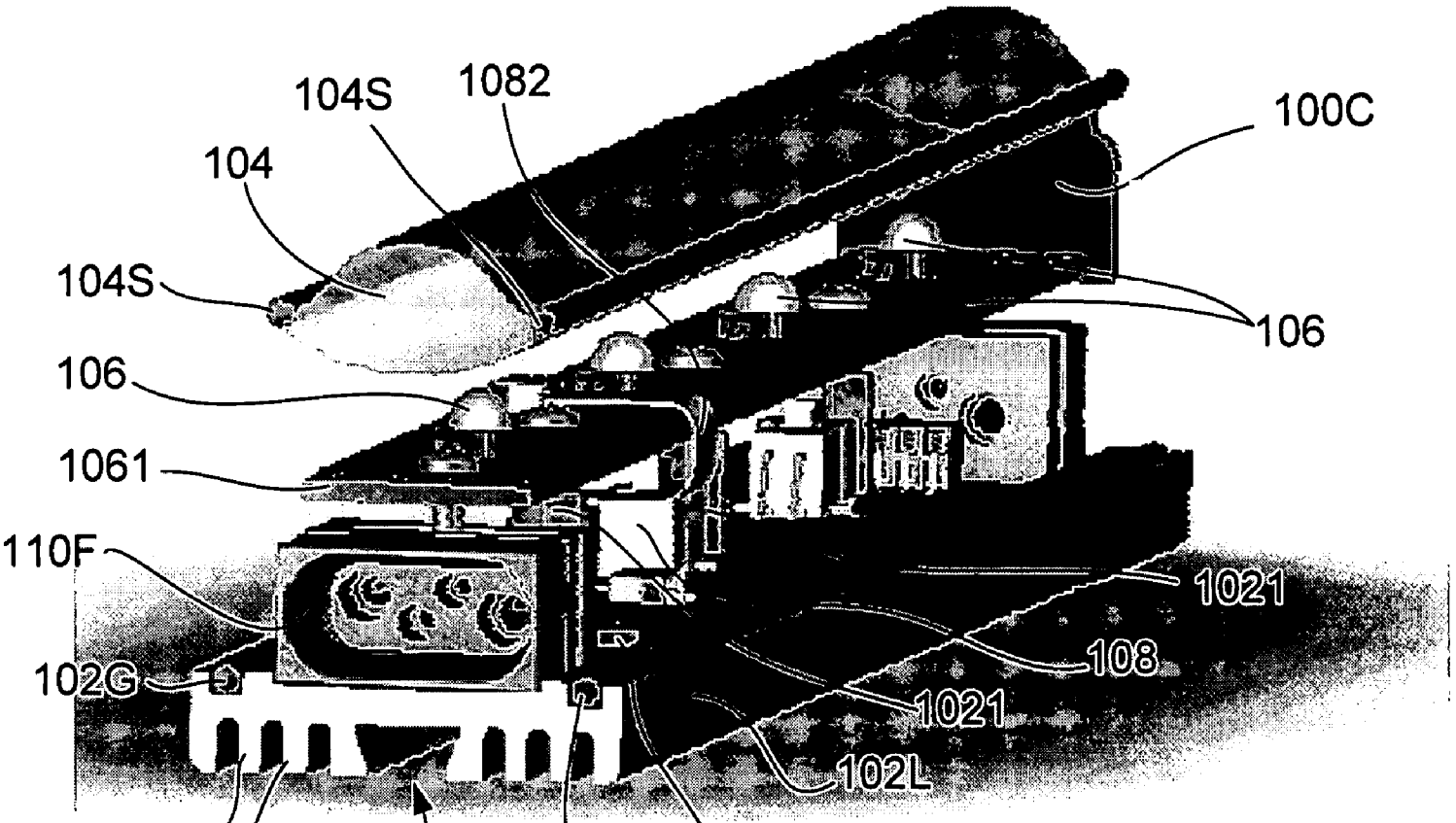
FIG. 3 is a perspective view depicting an example of how various elements, which comprise the lighting fixture depicted in FIGS, 1 and 2, can be arranged/connected with respect to one another.

FIGS. 3 and 4 illustrate the housing without its side walls to enable the manner in which the various elements are arranged in the interior of the housing, to be depicted clearly. The illustrated circuitry arrangement is such that, as illustrated in FIG. 4, the LED's 106 are supported on a LED support board 1061.

Figure 6:
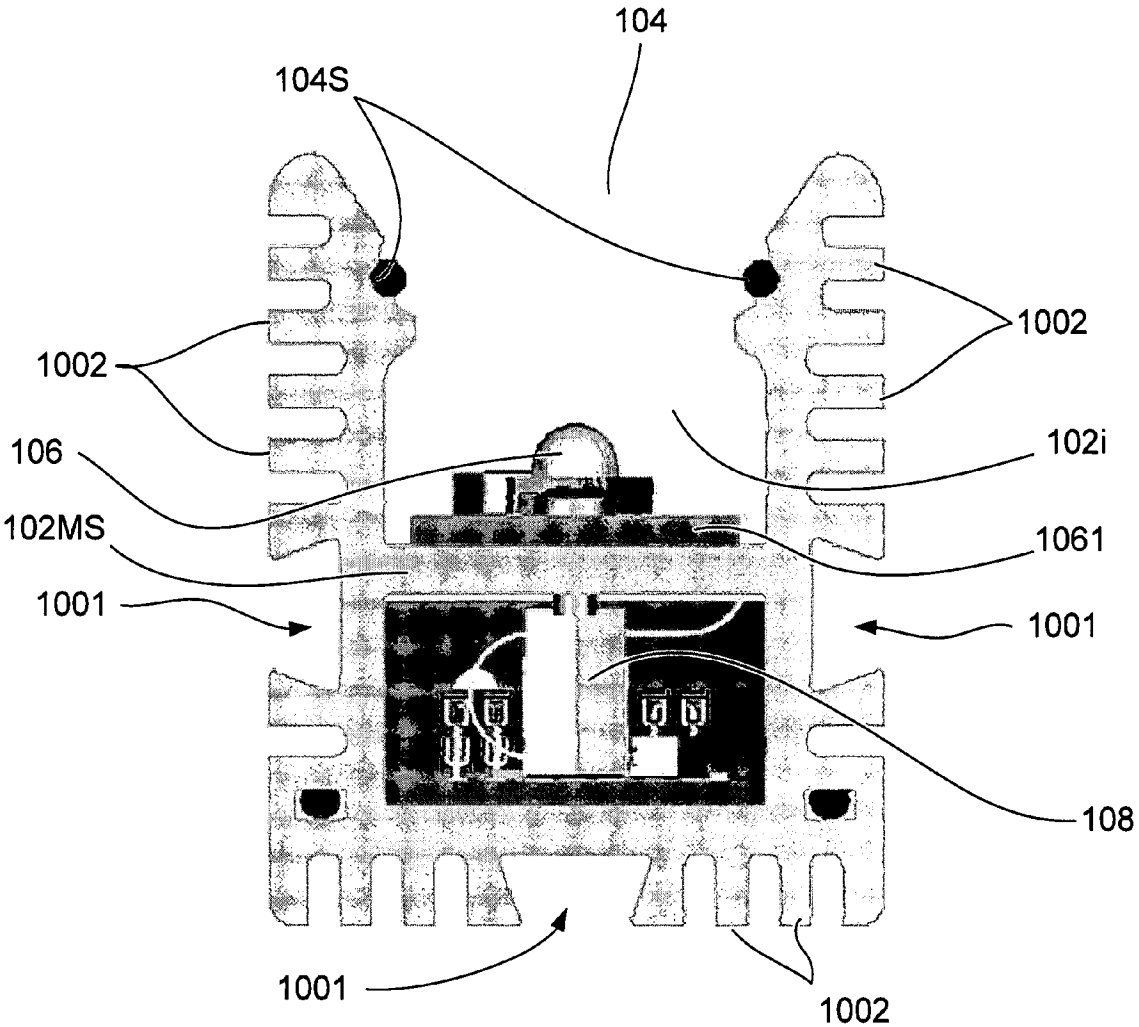
FIG. 6 is a sectional view of the lighting fixture depicted in FIG. 1.

The circuit elements (no numeral) which comprise the circuitry 108 and which are used to control the LED, are disposed on a second board 1081 so as be spaced from that on the board 1061 on which the LED are mounted and in direct contact with the housing 102 so as to provide a direct heat sinking effect. If desired, the LED support board 1061 can comprise a metal clad PCB (viz., MCPCB). This support board 1061 is, as depicted in FIG. 6, supported on the mid-span 102MS of the "H"-like sectioned portion of the upper extruded member 102U, and is electrically isolated from the board 1081 on which the circuits (of the circuitry 108) are mounted. The disposition of the support board 1061 on the mid-span 102MS facilitates heating sinking to the remainder of housing 102.

Stud-like standoff members 1021, in this particular embodiment, are rigid with the lower extruded portion 102L of the housing and arranged to have internal threading to facilitate a screw that extends down through the LED PCB 1061 through the "H"-shaped extrusion and threads into standoff to clamp the entire assembly together so that there no visible screws on the outside of the assembly.

An electrical connection is established between the support board 1061 and the lower board 1081 by way of a flex circuit or like type of arrangement 1082.

Although not illustrated per se, the circuitry 108 can be connected either in serial or in parallel with the socket/connectors 110, as preferred. The parallel connection which can be established using pass through wires, for example, of course provides for the failure of a plurality of daisy-chained fixtures and ensures that current will be supplied to the remaining functioning units.

The housing 102, in this embodiment, is formed with three mortises 1001 which are each shaped to receive a dovetail of an accessory in the manner discussed above. In this illustrated embodiment, the dimensions of each of the mortises are the same. This, as noted above, tends to maximize interchangeability. Fins 1002 are provided adjacent each of the mortises 1001. These fins 1002, while not being related to the connection of the accessories (illustrated in FIGS. 7-21 for example) to the housing 102 are such as to maintain adequate structural rigidity and are such as to also function as cooling fins which facilitate heat dissipation.

The lens 104 which is provided in this embodiment can be omitted if so desired. However, in this instance it is retained in position by sealing elements 104S which are disposed in the open end of the housing 100 as will be appreciated from FIGS. 5 and 6 for example. In the illustrated embodiment, these sealing elements comprise solid silicone O-rings. This arrangement closes off the interior of the housing 102*i* and protects the light sources 106 and circuitry from dust and other contamination such as flying insects and the like which tend to be attracted to the light and collect in the cavities surrounding the illuminating elements. The ends of the housing 100 are closed off by end caps 100C. In at least one particular embodiment, the end caps 100C can be are plastic or aluminum and configured (not shown) to fit over the entire cross section of the housing.

Figure 5:
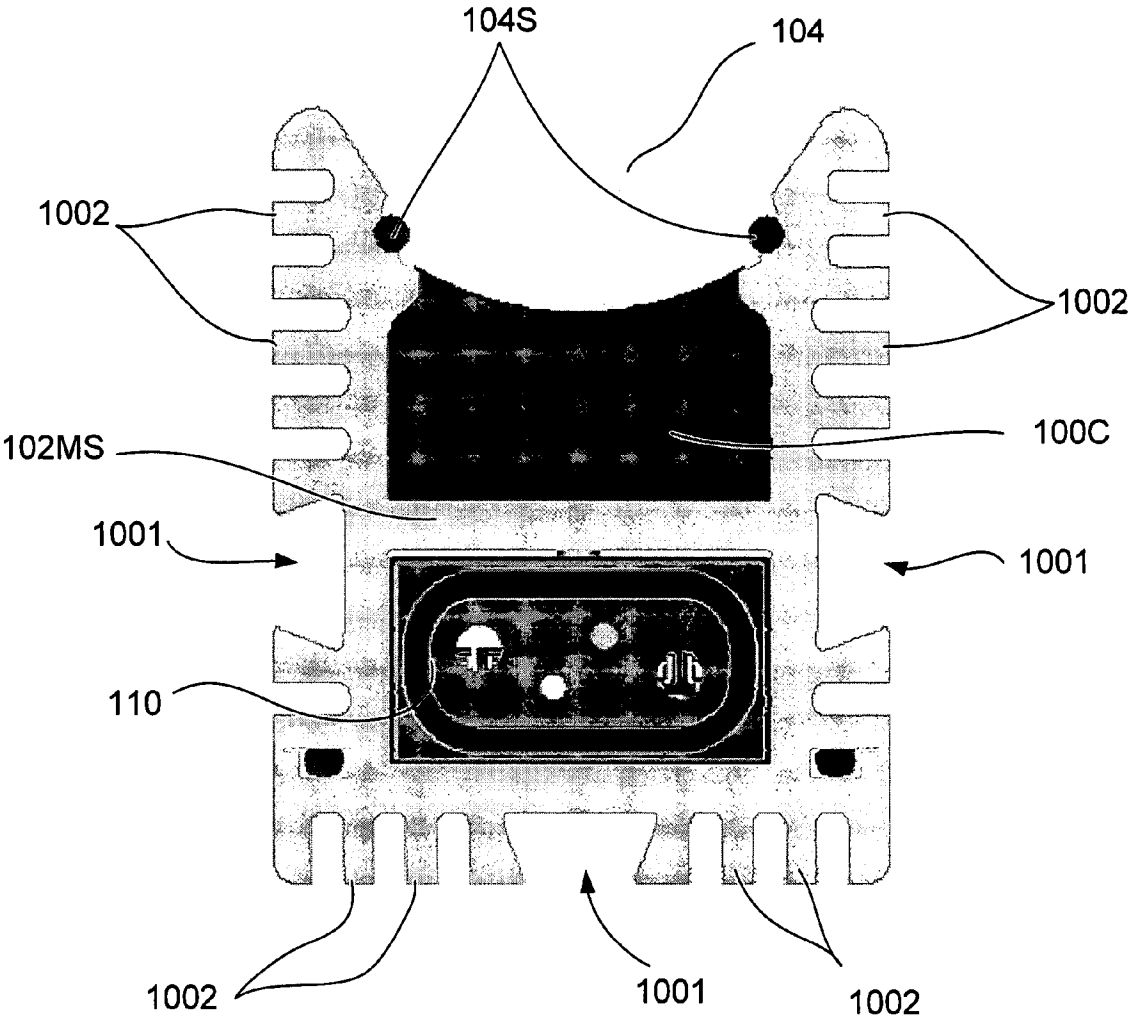
FIG. 5 is an end view of the lighting fixture depicted in FIG. 1, illustrating the positioning of the mortises which form connection features in accordance with the embodiments of the invention.

Although only three mortises are illustrated as being provided in the housing 100, it will be appreciated from FIGS. 5 and 6 that, for the given size of the housing and mortises, up to three mortises could be arranged side-by-side, if so desired.

FIGS. 7-22 illustrate examples of accessories that can be used in accordance with the invention. FIG. 7 is a side view illustrating the profile of a heatsink which can be connected to the housing using the dovetail that is provided on its base. This heatsink can be provided with a small fan or the like, if so desired. One or more can connect to the housing as required.

FIG. 8 is a side view illustrating the profile of a cover which can be connected to the housing using the dovetail that is provided on its base. This cover can transparent or opaque, hollow and or decorated in any suitable manner. The external shape of the cover is not limited to that which is illustrated and a large variety of shapes and sizes can be readily envisaged.

FIG. 9 is a side view illustrating the profile of a reflector which can be connected to the housing using the dovetail that is provided on its inboard surface. This reflector while being illustrated with an inboard dovetail, can also be provided with one on the other side to allow for connection to another housing.

FIG. 10 is a side view illustrating the profile of an angle mounting bracket which can be connected to the housing using a dovetail that is provided on an extension which protrudes from a connection member. The connection member in this embodiment is perforated and arranged to be screwed or otherwise fastened to a wall or the like.

FIG. 11 is a side view illustrating the profile of a straight mounting bracket which, like that illustrated in FIG. 10, can be fastened to a wall or the like and which can be used to support a housing connected to the housing using the dovetail that is provided on its base.

FIG. 12 is a side view illustrating the profile of a swivel mounting bracket which can be connected to the housing using the dovetail that is provided on the end of a pivotally mounted member. FIG. 13 is a side view illustrating the profile of another example of a straight mounting bracket which can be connected to the housing using the dovetail that is provided at one end of the bracket.

FIG. 14 is a side view illustrating the profile of a fixture-to-fixture/fixture connection element which can be connected to one or more housings/accessories using the dovetails that are provided at each end. FIG. 15 is a side view illustrating the profile of another embodiment of a fixture-to-fixture/fixture connection element which can be connected to one or more housings/accessories using the dovetails that are provided at each end.

FIG. 16 is a side view illustrating the profile of a further embodiment of an angled fixture-to-fixture/fixture connection element which can be connected to one or more housings/accessories using the dovetails that are provided at each end. FIG. 17 is a side view illustrating the profile of a fixture-to-fixture mounting bracket having dual dovetail connection elements.

Figure 20:
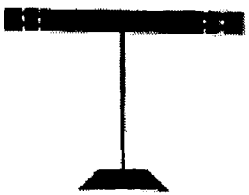
FIG. 20 is a side view illustrating the profile of a cable mounting bracket which can be connected to the housing using a dovetail that is provided at the end of a cable.
Figure 19:
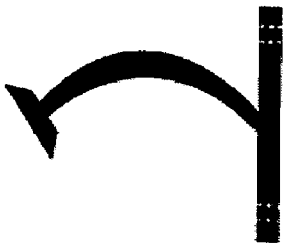
FIG. 19 is a side view illustrating the profile of a flexible mounting which can be connected to the housing using a dovetail that is provided at the end of a curved support member.

FIG. 18 is a side view illustrating the profile of a second reflector which can which can be connected to the housing using a dovetail that is provided on its base. FIG. 19, on the other hand, is a side view illustrating the profile of a flexible mounting which can be connected to the housing using a dovetail that is provided at the end of a curved support member. FIG. 20 is a side view illustrating the profile of a cable mounting bracket which can be connected to the housing using a dovetail that is provided at the end of a cable.

Figure 21:
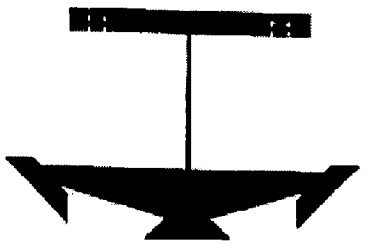
FIG. 21 is a side view illustrating the profile of a cable mounting bracket configured for connection to multiple fixtures/accessories.
Figure 22:
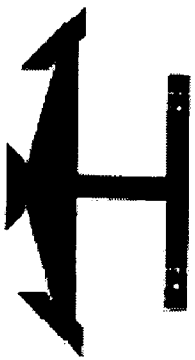
FIG. 22 is a side view illustrating the profile of a rigid mounting bracket that is configured for connection to multiple fixtures/accessories.

FIG. 21 is a side view illustrating the profile of a cable mounting bracket configured for connection to multiple fixtures/accessories. FIG. 22 on the other hand, is a side view illustrating the profile of a rigid mounting bracket that is configured for connection to multiple fixtures/accessories.

As will be appreciated, these accessories are merely exemplary of the arrangements which are possible and that the modifications and variations that are possible will be self-evident to the person skilled in the art to which the invention pertains or most closely pertains.

It will be readily appreciated by one of skill in the art to which the instant invention pertains, the embodiments according to the present invention fulfill many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An interconnection system, comprising: a housing having multiple exterior surfaces, the housing being configured to receive an electrical device therein, a plurality of the multiple exterior surfaces each having at least one mortise connection feature formed therein which is configured to receive a tenon associated with an accessory and to connect the accessory to the housing, wherein the LED are mounted on a first board which is supported in a spaced relationship with a second board on which LED control circuitry is supported, wherein the first board is supported on standoffs which are rigid with the housing and wherein the second board is disposed on an inner surface of the housing.

2. The interconnection arrangement as set forth in claim 1, wherein the electrical device comprises a light generating arrangement.

3. The interconnection arrangement as set forth in claim 2, wherein the light generating arrangement comprises a plurality of LED (Light emitting diodes).

4. The interconnection arrangement as set forth in claim 2, further comprising a lens which is disposed with the housing to close a cavity in which the light generating arrangement is disposed and which is configure to direct light produced by the light generating arrangement out of the housing in a predetermined manner.

5. The interconnection arrangement as set forth in claim 1, wherein the standoffs are thermally conductive.

6. The interconnection arrangement as set forth in claim 1, wherein the first and second board are electrically connected by a flex circuit.

7. The interconnection arrangement as set forth in claim 1, wherein the housing is provided with electrical connectors at each end.

8. The interconnection arrangement as set forth in claim 1, wherein the electrical connectors are configured to allow the housing to be connected with other housings of similar configuration.

9. The interconnection arrangement as set forth in claim 1, wherein the connection with the other housings forms a daisy chain type of connection.

10. The interconnection arrangement as set forth in claim 1, wherein the at least one mortise is shaped to receive a dovetail shaped tenon therein.

11. The interconnection arrangement as set forth in claim 1, wherein the housing is elongate and wherein the at least one mortise extends along at least a portion of the elongate housing.

12. The interconnection arrangement as set forth in claim 1, wherein the housing comprises at least one extruded member extruded from an extrudable material.

13. The interconnection arrangement as set forth in claim 12, wherein the extruded member is configured to have fins extending along side at least one of the at least one mortise.

14. The interconnection arrangement as set forth in claim 1, wherein the accessory comprise one of: a mounting bracket, a cover, a connection element, a heatsink, and a reflector.

15. The interconnection system as set forth in claim 1, wherein the housing is linear in configuration and is populated with high brightness (HB) LEDs which comprise the electrical device, the housing comprising upper and lower extrusion members.

16. The interconnection system as set forth in claim 15, wherein the HB LEDs are installed to a multilayer or single layer MCPCB comprised of a printed circuit board with an aluminum or copper substrate via direct solder connection or thermally conductive epoxy.

17. The interconnection system as set forth in claim 16, wherein the LED MCPCB is attached to the linear housing via screws that pass through the upper extrusion member and into threaded standoffs rigid with the lower extrusion member to clamp the upper and lower extrusion members together and form a watertight seal therebetween.

18. The interconnection system as set forth in claim 16, wherein the MCPCB is installed via screws to the upper extrusion member.

19. The interconnection system as set forth in claim 18, wherein, in order to provide adequate thermal transfer from the MCPCBs to the upper extrusion member, a thermally conductive transfer material is disposed between the MCPCB and the upper housing.

20. The interconnection system as set forth in claim 16, wherein the MCPCB may be configured with one or more high Brightness (HB) LEDs and with or without additional electronic components including current limiting devices and a drive circuit.

21. The interconnection system as set forth in claim 20, wherein the drive circuit is installed to a lower optional circuit board (PCB) and is electrically connected to the upper MCPCB by one of a flex circuit and a discrete wire.

22. The interconnection system as set forth in claim 21 wherein a dimming circuit is installed on a drive circuit.

23. The interconnection system as set forth in claim 15, further comprising a collimating extruded linear optic which extends along an entire length of the upper extrusion member and which is configured to unify light emission and determined main beam angle.

24. The interconnection system, as set forth in claim 23, wherein the collimating extruded linear optic has an optic profile configured to create beam emitting angles of at least one of 15, 30, 45, and 65 degrees.

25. The interconnection system as set forth in claim 23, wherein the upper extrusion member is formed with a shelf on which the collimating extruded linear optic is configured to set, the shelf having a rounded cutout configured to receive a gasket which compresses between an edge of the collimating extruded linear optic and the cutout to retain collimating extruded linear optic in position and seal the upper extrusion member from contamination.

26. The interconnection system as set forth in claim 15, further comprising electrical connectors on each end of the housing, one comprising a female connection member and the other comprising a male plug member, the female connection member and the male plug member being configured to allow the housing to be multiply daisy-chained to other similarly constructed housings.

27. The interconnection system as set forth in claim 26, wherein each female connection member and each male plug member are configured with four contact positions, two for power, and two for a dimming signal.

28. The interconnection system as set forth in claim 26, further comprising pass through wires which connects the female connection member and the male plug member of each housing so that when daisy-chained with another housing, a voltage is available at the endmost one of the female connection member and the male plug member.

29. The interconnection system as set forth in claim 28, wherein when a driver circuitry is installed to the PCB and only 1 PCB is used, a flex circuit is used to establish a direct connection with the pass through wires.

30. The interconnection system as set forth in claim 28, wherein a junction PCB is used in place of a driver PCB, the junction PCB is connected to the pass through wires and at least one the LED board and at least one flex circuit.

31. The interconnection system as set forth in claim 30 wherein when a junction PCB is used driver circuits may be remotely disposed.

32. The interconnection system as set forth in claim 26, wherein the housing is sealed at its both ends by plastic injection molded end caps which are fitted with gaskets and which have a cutout for the electrical connectors to pass therethrough.

33. An interconnection system, comprising: a housing having multiple exterior surfaces, the housing being configured to enclose an electrical device; a plurality of shaped mortise connection features, one or more of the connection features being formed in selected exterior surfaces of the housing, the connection features being configured to receive a shaped tenon associated with an accessory; and a plurality of accessories each having a shaped tenon receivable in a selected one of the plurality of connection features in an accessory connection manner, wherein the LED are mounted on a first board which is supported in a spaced relationship with a second board on which LED control circuitry is supported, wherein the first board is supported on standoffs which are rigid with the housing and wherein the second board is disposed on an inner surface of the housing.

34. The interconnection arrangement as set forth in claim 33, wherein the shaped tenon and the shaped mortise are respectively dovetailed shaped tenons and mortises.

35. The interconnection arrangement as set forth in claim 33, wherein the housing is elongate and wherein the shaped mortise connection features are elongate and extend along at least a portion of the elongate housing.

36. The interconnection arrangement as set forth in claim 33, wherein the electrical device is a light generating arrangement.

37. An interconnection arrangement comprising: an elongate housing having two side walls and a bottom wall; and at least one dovetail mortise formed in each of the two side walls and in the bottom wall, each dovetail mortise having essentially the same dimensions and each configured to connectively engage with a dovetail tenon associated with an accessory, wherein the LED are mounted on a first board which is supported in a spaced relationship with a second board on which LED control circuitry is supported, wherein the first board is supported on standoffs which are rigid with the housing and wherein the second board is disposed on an inner surface of the housing.

38. The interconnection arrangement as set forth in claim 37, wherein each dovetail mortise extends along the length of the elongate housing and is open at least one end of the elongate housing to allow the dovetail tenon to be slid thereinto when an accessory is being connected with the housing.

39. The interconnection arrangement as set forth in claim 38, further comprising a plurality of accessories each having a dovetail tenon and each being connectable to the housing, the accessories comprising at least a mounting bracket, a cover, a connection element, a heatsink, and a reflector.

40. The interconnection arrangement as set forth in claim 37, further comprising an electrical device which is operatively disposed in the housing.

41. The interconnection arrangement as set forth in claim 40, wherein the electrical device comprises a light generating arrangement.

42. The interconnection arrangement as set forth in claim 37, wherein the light generating arrangement comprises LED (light emitting diodes).

* * * * *